United States Patent [19]

Ricard

[11] 4,041,303

[45] Aug. 9, 1977

[54] VEHICLE HEADLAMPS

[75] Inventor: Jacques Ricard, Fontenay sous Bois, France

[73] Assignee: Cibie Projecteurs, Bobigny, France

[21] Appl. No.: 601,547

[22] Filed: Aug. 4, 1975

[30] Foreign Application Priority Data

Aug. 23, 1974 France ..... 74.28980

[51] Int. Cl.[2] ..... F21M 3/04

[52] U.S. Cl. ..... 240/41.4 R; 240/106.1

[58] Field of Search ..... 240/41.4 R, 41.4 D, 240/106 R, 106.1, 7.1 R

[56] References Cited

U.S. PATENT DOCUMENTS

| | | | |
|---|---|---|---|
| 1,235,675 | 8/1917 | Ford | 240/41.4 R |
| 1,319,822 | 10/1919 | Winston | 240/41.4 R |
| 1,341,128 | 5/1920 | Hobbie | 240/41.4 R |
| 1,788,936 | 1/1931 | Wood | 240/41.4 R |
| 2,044,224 | 6/1936 | Peple, Jr. | 240/41.4 R |
| 2,846,568 | 8/1958 | Falge | 240/106.1 |
| 2,855,500 | 10/1958 | Holman | 240/41.4 R |
| D. 93,553 | 10/1934 | Hundley | 240/41.4 R |

*Primary Examiner*—L. T. Hix
*Assistant Examiner*—J. A. LaBarre

[57] ABSTRACT

A pair of vehicle headlamps have front surfaces which are inclined to a central longitudinal plane and the optical axes of the headlamps. Each lens is provided with deflector elements affording a pair of rear surfaces of which one is inclined to the optical axis and one is parallel thereto.

3 Claims, 14 Drawing Figures

VEHICLE HEADLAMPS

BACKGROUND OF THE INVENTION

This invention relates to pairs of vehicle headlamps. Modern vehicles often have an aerodynamic shape and in order to maintain the general line of the body, the front lens of each headlamp must follow this shape so that the front lenses of the headlamps are often inclined symmetrically on either side of the central plane of the vehicle. As a consequence, the front lenses are no longer perpendicular to the longitudinal axis of the vehicle, although the optical axes of the headlamps do remain substantially parallel to the central longitudinal plane of the vehicle since their beams must illuminate along the axis of the vehicle.

Front lenses of headlamps usually have corrugations in some parts in order to spread or concentrate the beams of light in specific zones. For this purpose deflector elements of symmetrical shape are used, i.e. the cross-section of the elements has at least one axis of symmetry. The elements can form a raised surface on the inner surface of the lens and spread the light substantially equally to the left and right, or else deflector elements having an asymmetrical shape are used, which spread the light preferentially in one direction to the left or right.

SUMMARY OF THE IVENTION

It is the object of the present invention to provide a set of motor vehicle headlamps which overcome certain disadvantages of the prior art which will be referred to in relation to FIGS. 1 and 2 of the drawings.

To this end, according to the present invention, a set of motor vehicle headlamps comprise at least one right-hand and one left-hand headlamp, the headlamps having optical axes which are substantially parallel to one another and to a central longitudinal plane extending between them, the headlamps having front lenses which are symmetrically inclined on either side of the said central plane, each lens having a region of prismatic elements for lateral spread of the beam, each element having a pair of surfaces inclined to one another, one surface being inclined to the optical axis and the other surface lying substantially parallel to the optical axis.

According to a preferred embodiment, the deflector elements are inclined to the vertical either by a different angle for each of the vehicle sides for distribution of the dipped beam, or symmetrically for the main beam. In the former case this enables the beam emitted by a left-hand headlamp to be spread in a horizontal direction and the beam emitted by a righ-hand headlamp to be spread along an inclined direction so that the cut-off between the illuminated and non-illuminated zones is distinct and without the corresponding zones being illuminated. In the second case the symmetrical spread is directed downwardly to illuminate the two sides of the road.

Of course, this specific arrangement of the deflector elements is applicable to headlamps providing just a main beam or the dipped beam, and to headlamps enabling both types of beams to be emitted. Specific zones corresponding to each of these two functions must then be provided on the headlamp lens.

With such a headlamp arrangement, an illumination is obtained which gives complete satisfaction and the headlamps are quite integral with the specific shape of the body.

The invention may be carried into practice in various ways but certain specific embodiments will now be discribed by way of example with reference to the accompanying drawings in which.

Figure 6:
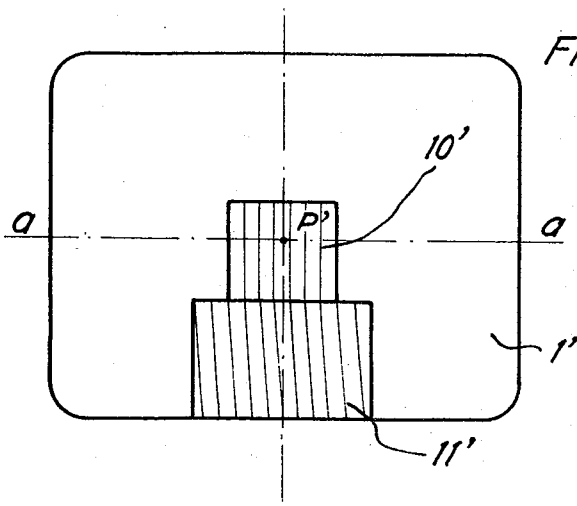
Figure 5:
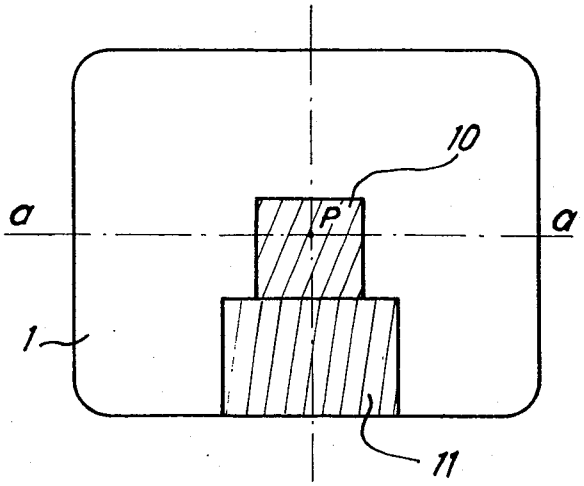
FIG. 5 is a front view of a right-hand headlamp with deflector elements according to the invention, for spreading the dipped beam and the main beam.
Figure 6A:
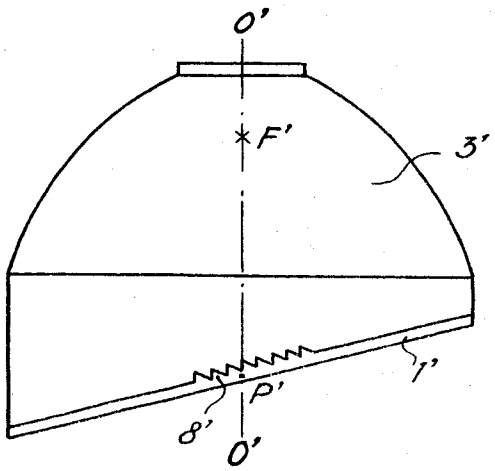
Figure 5A:
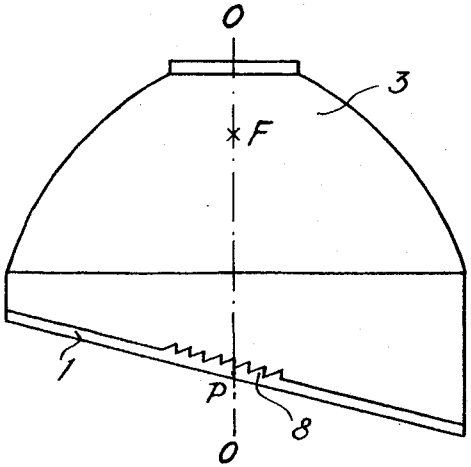
Figure 7B:
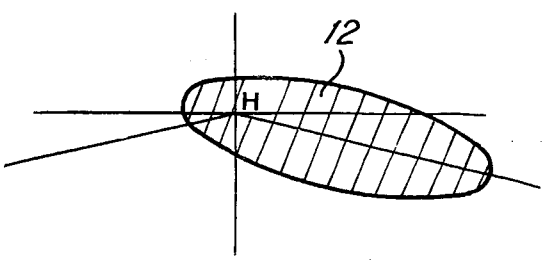
Figure 7C:
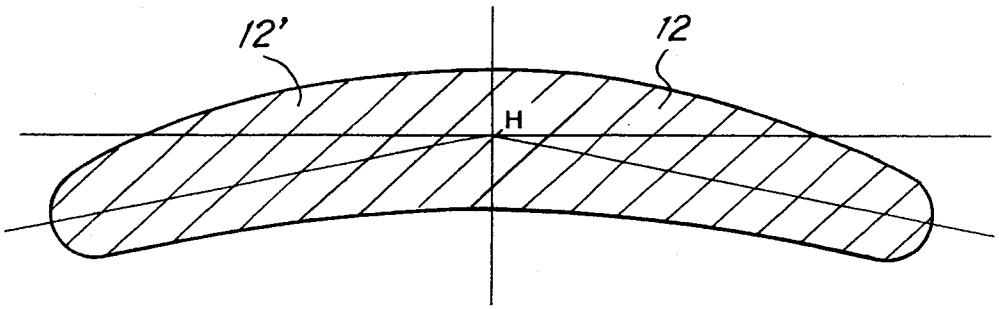
Figure 7A:
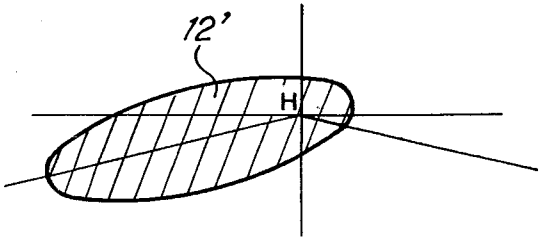
Figure 8A:
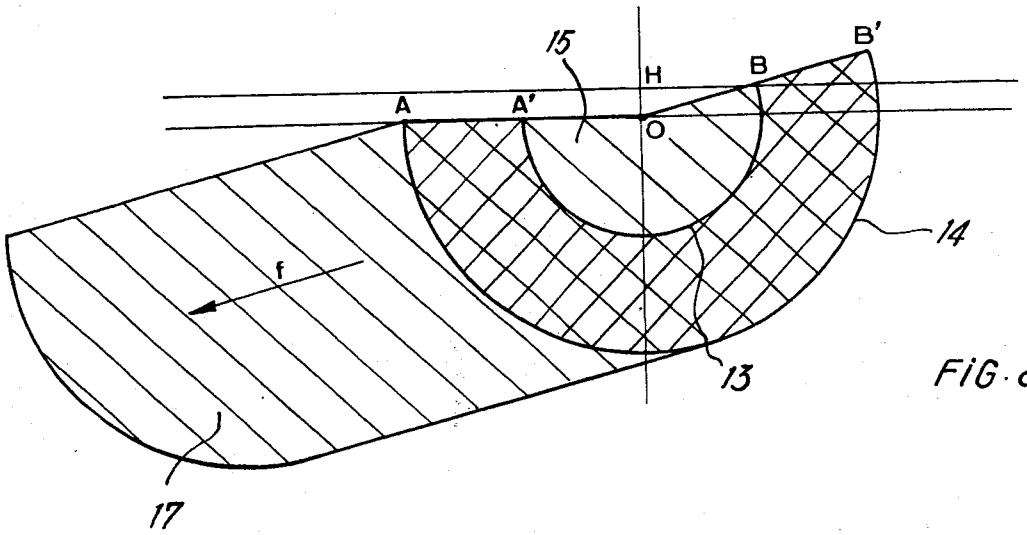
Figure 8B:
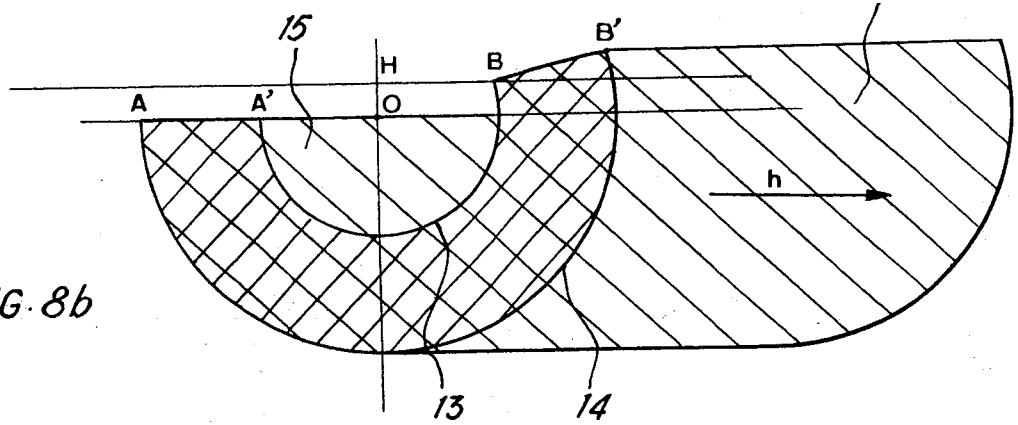
Figure 8C:
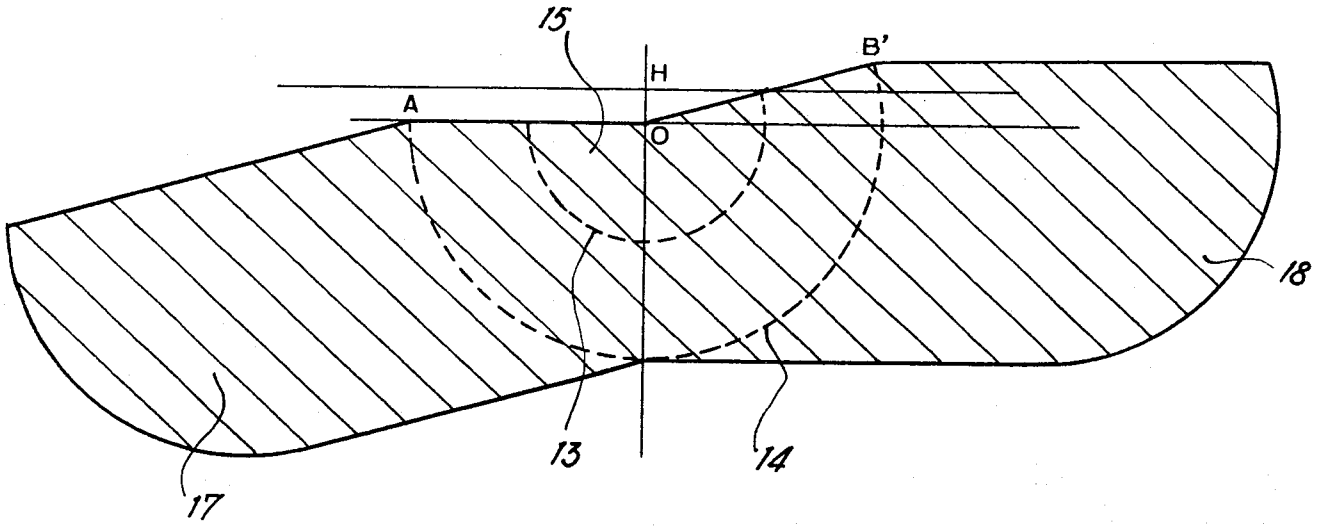

FIG. 5*a* is a sectional plan on the plane *a—a* of the headlamp shown in FIG. 5;

FIG. 6 and FIG. 6*a* diagrammatically illustrate a left-hand headlamp according to the invention with characteristics similar to those of the right-hand headlamp shown in FIG. 5 and 5*a*;

FIG. 7*a* is the main beam image produced by the right-hand headlamp;

FIG. 7*b* is the main beam image produced by the left-hand headlamp;

FIG. 7*c* is the resultant beam, which is the sum of the images shown in FIGS. 7*a* and 7*b*;

FIG. 8*a* is the dipped beam image from the zone situated near the point P of the right-hand headlamp;

FIG. 8*b* is the dipped beam image from the zone situated near the poing P of the left:hand headlamp; and FIG. 8*c* is the resultant beam of the sum of the images shown in FIGS. 8*a* and 8*b*.

Figure 1:
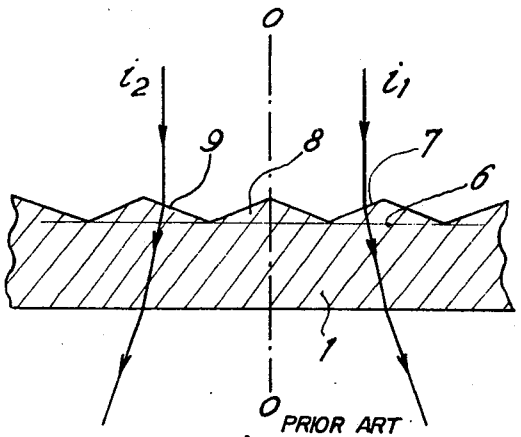
PRIOR ART FIG. 1
FIG. 1 is a cross-section of a prior front lens with symmetrical deflector elements.
Figure 2:
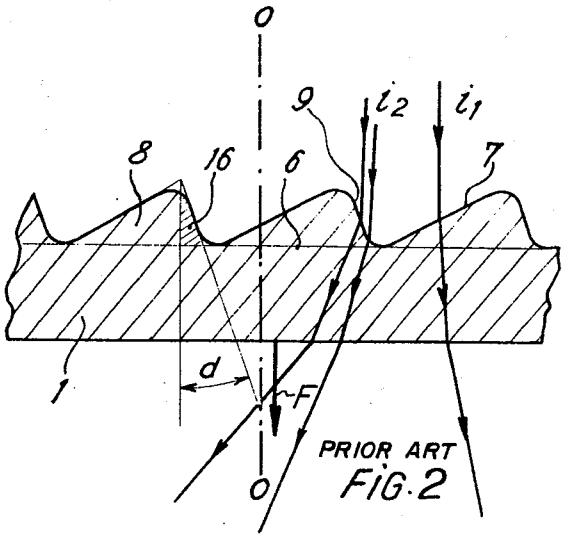
PRIOR ART FIG. 2
FIG. 2 is a cross section showing another prior lens with asymmetrical elements.

To illustrate the state of the art FIGS. 1 and 2 show deflector elements disposed on the inner surface of a headlamp lens.

The lens portion 1 shown in FIG. 1 has symmetrical deflector elements 8 on its inner surface. An incident beam $i_1$ from the reflector (not shown) and passing through the lens is deflected as it meets the incident face 7 of an element 8 of the front lens, and the leaves the headlamp. An incident beam $i_2$ meeting the other surface 9 of a deflector element will be deflected by the same angle as the beam $i_1$ but in the opposite direction, since the deflector elements 8 are symmetrical with respect to the optical axis 00 of the headlamp.

Referring to FIG. 2, the raised pattern on the inner surface of the front lens of the headlamp is formed from deflector elements 8, the section of which has no axis of symmetry, the said elements being termed asymmetrical. Such deflector elements 8, which are produced by moulding with the front lens, which is of glass, have a surface 9 forming mould draft angle *d* to the direction of release from the mould F, which is perpendicular to the plane of the front lens 1, the minimum draft or "clearance" angle being about 10°. This clearance forms a prism 16 integral with the main prism formed by the surface 7 and the inner surface 6 of the lens. This prism 16 receives part of the incident beam, and beams $i_2$ meeting the surface 9 are deflected in opposite directions to the deflection of the rays $i_1$ and by a variable angle. Since asymmetrical deflector elements are used to give a beam which is deflected in a preferential directon, the prisms 16 resulting from the draft of clearance angle have an undesirable effect, because they deflect a part of the beam of light in a direction opposed to that required. This therefore results in a loss of light in the required direction and an undesirable increase in illumination in an opposite direction. Thus if, for example, the deflector elements 8 are so disposed that the headlamps providing a main beam illuminate the sides of the road to a greater degree, part of the beam will be deflected upwards, i.e., towards zones which do not require to be illuminated. Also, in the case of the dipped beams, the rays deflected by the stray clearance prisms 16 are likely to result in some unwanted illuminaton of points situated above cut-off.

The disadvantage of the clearance angle is particularly apparent when the front lenses are perpendicular to the longitudinal axis of the vehicle, but it is also apparent when the front lenses are inclined. Also, this disadvantage is then in addition to the fact that the distance between the focus of the reflector and the center of the lens is considerable in view of the inclinaton of the latter. Thus the dipped-beam filament, being disposed longitudinally and slightly forwardly of the focus, there will be a reduced zone near the point P, the intersection of the axis of the reflector and the lens, where there will be a concentration of rays of light from different points of the reflector and hence at different inclinations. To obviate this disadvantage in this zone, asymmetrical deflector elements are required and this accentuates the adverse effect of the clearance angle.

Figure 3:
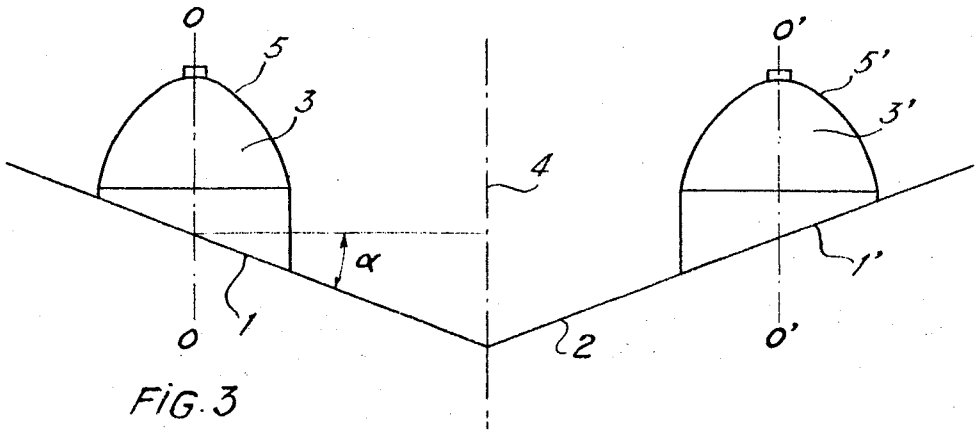
FIG. 3 is a diagrammatic plan view of an arrangement according to the invention of front lenses inclined symmetrically on either side of a central plane of the vehicle.

FIG. 3 diagrammatically illustrates two headlamps, the front lenses 1 and 1' of which have the general shape of the vehicle body 2, i.e., they are inclined to the central longitudinal plane 4 of the vehicle. The optical axis of the right-hand headlamp 3 and the optical axis of the left-hand headlamp 3', however, are parallel to the said plane. The reflectors 5 and 5' of the two headlamps are disposed as in conventional constructions, and the same applies to the associated lamps.

Figure 4:
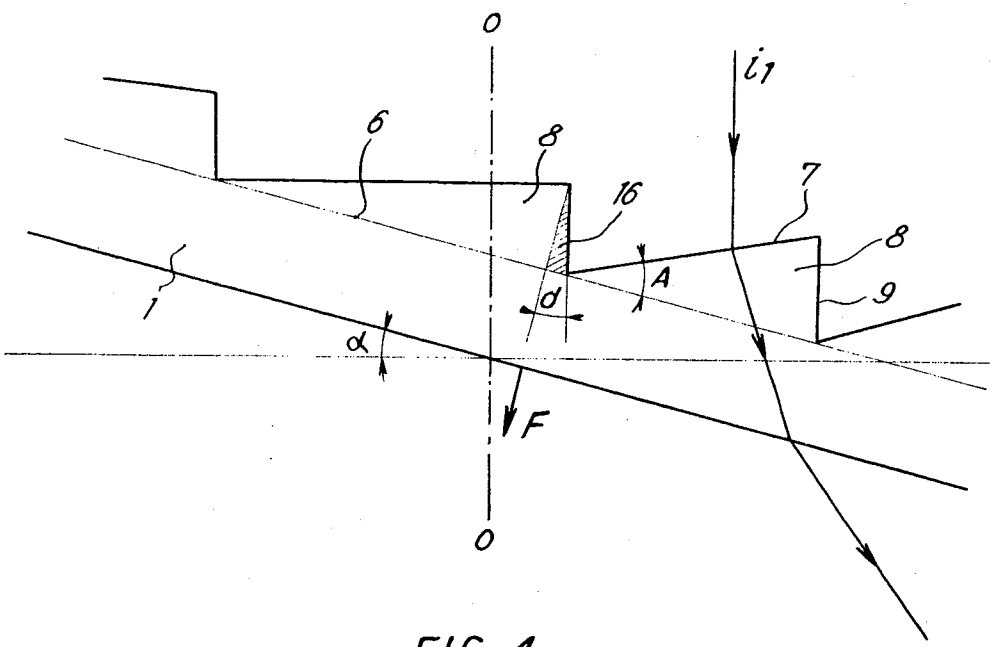
FIG. 4 is a partial section of the front lens of the right-hand headlamp of FIG. 3 with prismatic deflector elements according to the invention.

FIG. 4 is a partial section of the front lens of the right-hand headlamp 3, the inner surface 6 of which has prismatic deflector elements 8. The lens 1 is inclined by an angle $\alpha$ to a perpendicular to the longitudinal axis of the vehicle. These deflector elements 8 have a prismatic section, whose angle at the apex A defined by the incident surface 7 of the prism and an inner plane 6 of the front lens, faces towards the central longitudinal plane 4 of the vehicle. Each of the angles of the apex A of the various prisms may have a different value or be constant depending upon the spread required, but in every case the inner plane 6 of the front lens 1 forms one of the sufaces of dihedron defining the apex angle A. The front lens 1 provided with prisms 8 is made of glass and produed by moulding, the lens being removed from the mould in the direction of arrow F in a direction perpendicular to the front surface of the lens 1. Removal from the mould requires a draft or clearance angle *d* to said direction sufficient to give correct production. According to the invention, the front lens 1 of the headlamp, being inclined by an angle $\alpha$, it is enough for said inclination to be at least equal to the clearance angle *d*, which is determined by construction by the type of moulding used, for the base 9 of the prism 8 to be able, according to the invention, to be made parallel to the optical axis of the headlamp and for the disadvantage produced by the draft or clearance angle to be eliminated. With the arrangement according to the invention, the incident beam of light $i_1$ from the headlamp reflector parallel to the optical axis of the latter is deflected towards the base 9 of the prism and then leaves the front lens 1. The base 9 corresponds to the clearance surface of the prisms which is parallel to the optical axis of the headlamp and which none of the beams of light $i_1$ meets. Stray deflection is therefore eliminated.

FIGS. 5 and 6 respectively show the right-hand and left-hand headlamps disposed on a vehicle according to the invention, i.e. inclined symmetrically on either side of the central longitudinal plane 4 of the vehicle. The front lens 1, 1' of each of the headlamps 3, 3' has bands 10, 10' near the point P, P' to spread the dipped beam and bands 11, 11' to spread the main beam. As will be seen from FIGS. 5*a* and 6*a*, which are plan sections of headlamps according to FIGS. 5 and 6, these bands comprise deflector elements 8, 8' of the same type as those described previously.

With regard to the bands 11, 11' providing the main beam spread, this inclination is symmetrical so as to illuminate the two sides of the road equally.

FIG. 7 shows the image obtained after the main beam has been spread according to the invention.

This image comprises two half-images 12, 12' respectively corresponding to the beam emitted by the right-hand headlamp (FIG. 7*a*) and the left-hand headlamp (FIG. 7*b*). These two half-images are superimposed in the central zone and are symmetrical with respect to a vertical axis, the end portions of the resulting beam being slightly inclined to ensure illumination of the sides of the roads.

With regard to the bands 10, 10' providing the dipped beam spread, the deflector elements 8, 8' are at different angles, the elements 8' preferably being vertical.

With this arrangement it is possible to spread each of the right-hand (FIG. 8*a*) and left-hand (FIG. 8*b*) unit beams in different directions. The centre P or P' of the lens being very far away from the reflector focus F or F' and the light emitter not being situated exactly at the focus, the dipped beam passing through the zone situated near the points P and P' of the lens as obtained on a screen at a distance of 25 meters (FIGS. 8*a* and 8*b*) is substantially a half-ring bounded by the lines 13 and 14. The image of this beam has a dark zone 15 and must necessarily be enlarged to give the cut-off according to AOB' corresponding to the standards, and in order to eliminate the surplus light at the bottom of the ring. The deflector prisms according to the invention enable the light to be spread and the difference in inclination to the vertical gives the spread 17 in the directon B', B, i.e. in the direction of arrow *f*, in the case of the right-hand headlamp, and a spread 18 in the direction A A', i.e. in the direction of arrow *h*, in the case of the left-hand headlamp. This spread being obtained without any stray deflection and particularly without any increased illumination at the points B, 15 and H defined on the reference screen (FIG. 8*c*).

Of course the invention has been described only by way of example and may undergo several modifications without departing from its scope; more particularly, a plurality of pairs of headlamps whether situated in the same horizontal plane or not, and inclined symetrically on either side of the central longitudinal axis, may have deflector elements according to the invention, one pair of headlamps may then provide the emission and spread of the main beam while another pair does the same for the dipped beam.

What I claim as my invention and desire to secure by Letters Patent is:

1. A lighting system for a motor vehicle comprising a right-hand and a left-hand headlamp, the headlamps having optical axes which are substantially parallel to one another and to a central longitudinal plane extending between them, along said vehicle, the head-lamps having front lenses which are symmetrically inclined on either side of the said central plane, each lens having a region of prismatic elements for lateral spread of the beam, each element having a pair of plane surfaces inclined to one another, and intersecting one another along a linear edge; one surface being inclined to the optical axis and the other surface lying exactly parallel to the optical axis.

2. A lighting system as claimed in claim 1, in which some of the prismatic elements of one headlamp for an offside beam, have their edges inclined to the vertical, whilst some of the prismatic elements of the other headlamp, for a nearside beam, have their edges extending substantially vertically.

3. A lighting system as claimed in claim 2, in which some of the prismatic elements of each headlamp have their edges inclined symmetrically so as to provide main beams which illuminate the sides of a road.

* * * * *